US011913457B2

(12) United States Patent
Clark

(10) Patent No.: US 11,913,457 B2
(45) Date of Patent: Feb. 27, 2024

(54) MAGNETIC PUMP

(71) Applicant: HMD Seal/Less Pumps Limited, Eastbourne (GB)

(72) Inventor: David Clark, Eastbourne (GB)

(73) Assignee: HMD Seal/Less Pumps Limited, Sussex (GB)

( * ) Notice: Subject to any disclaimer, the term of this patent is extended or adjusted under 35 U.S.C. 154(b) by 225 days.

(21) Appl. No.: 17/429,294

(22) PCT Filed: Feb. 7, 2020

(86) PCT No.: PCT/GB2020/050277

§ 371 (c)(1),
(2) Date: Aug. 6, 2021

(87) PCT Pub. No.: WO2020/161498

PCT Pub. Date: Aug. 13, 2020

(65) Prior Publication Data

US 2022/0106960 A1 Apr. 7, 2022

(30) Foreign Application Priority Data

Feb. 8, 2019 (GB) ..... 1901782

(51) Int. Cl.

| | |
|---|---|
| ***F04D 13/02*** | (2006.01) |
| ***F04D 13/06*** | (2006.01) |
| ***F04D 15/00*** | (2006.01) |
| ***F04D 29/58*** | (2006.01) |
| ***F04D 29/041*** | (2006.01) |

(Continued)

(52) U.S. Cl.
CPC ..... *F04D 13/026* (2013.01); *F04D 13/024* (2013.01); *F04D 13/025* (2013.01);
(Continued)

(58) Field of Classification Search
CPC .. F04D 13/026; F04D 13/027; F04D 29/0413; F04D 13/025; F04D 29/047;
(Continued)

(56) References Cited

U.S. PATENT DOCUMENTS 5,248,245 A * 9/1993 Behnke ..... F04D 13/026 415/110
5,297,940 A * 3/1994 Buse ..... F04D 13/024 417/423.11

(Continued)

FOREIGN PATENT DOCUMENTS

| | | |
|---|---|---|
| GB | 2471908 A | 1/2011 |
| JP | S6338698 A | 2/1988 |
| WO | 2018123452 A1 | 7/2018 |

OTHER PUBLICATIONS

International Search Report and Written Opinion dated Apr. 17, 2020, for International Patent Application No. PCT/GB2020/050277.

(Continued)

*Primary Examiner* — Peter J Bertheaud
(74) *Attorney, Agent, or Firm* — Renner, Otto, Boisselle & Sklar, LLP

(57) ABSTRACT

A magnetic pump comprising: a pump body supporting an output shaft on a wet side of the pump and having an inlet and at least one outlet for pumped fluid; an input drive element on a dry side of the pump, at least one magnet for coupling the input and output shafts such that motion of the input shaft causes motion of the output shaft, a pressure containing structure mounted on the pump body for separating the dry and the wet sides, wherein the pump includes: one or more pathways through which pumped fluid can pass so as to lubricate one or more moving parts within the pressure containing structure, and a monitoring port/channel through which one or more properties of pumped fluid passing through the one or more pathways can be sensed.

15 Claims, 6 Drawing Sheets

(51) Int. Cl.
*F04D 29/047* (2006.01)
*F04D 29/42* (2006.01)

(52) U.S. Cl.
CPC ..... *F04D 13/027* (2013.01); *F04D 13/0606* (2013.01); *F04D 13/0626* (2013.01); *F04D 15/0077* (2013.01); *F04D 29/047* (2013.01); *F04D 29/0413* (2013.01); *F04D 29/426* (2013.01); *F04D 29/586* (2013.01); *F04D 29/588* (2013.01)

(58) Field of Classification Search
CPC .... F04D 13/024; F04D 29/588; F04D 29/426; F04D 29/586; F04D 13/0626; F04D 13/0606; F04D 15/0077
See application file for complete search history.

(56) References Cited

U.S. PATENT DOCUMENTS

| | | | | |
|---|---|---|---|---|
| 5,525,039 | A * | 6/1996 | Sieghartner ..... | F04D 13/026 417/244 |
| 6,722,854 | B2 * | 4/2004 | Forsberg ..... | F04D 13/027 417/63 |
| 2002/0098089 | A1 | 7/2002 | Forsberg | |

OTHER PUBLICATIONS

Search Report dated Jul. 30, 2019, for GB Patent Application No. GB1901782.1.

* cited by examiner

MAGNETIC PUMP

This application is a national phase of International Application No. PCT/GB2020/050277 filed Feb. 7, 2020, which claims priority to Great British Patent Application No. 1901782.1 filed Feb. 8, 2019, all of which are hereby incorporated herein by reference in their entireties.

This invention relates to a magnet driven pump and, in particular, a magnet driven pump that permits ready sensing of one or more properties of process fluid which is circulated within the pump.

Historically the construction of a seal-less magnet-driven centrifugal pump has relied upon a thin walled tube arrangement known as a containment shell or 'can' forming part of the pump pressure vessel to provide the boundary between the magnetic coupling parts. A standard magnetic coupling has two parts, one of which is inside the pump (the driven part) on the wet side, and the other side of which is outside of the pump (the driver) on the dry side.

The reasons for this sort of coupling are typically related to the material which is desired to be pumped as this type of pump is typically used to pump highly corrosive, toxic or otherwise dangerous or hazardous fluids, for which it is vital that the risk of leakage is minimised. Thus, a seal-less magnet-driven centrifugal pump provides an arrangement in which there is no moving seal through which leakage might occur, but rather provides a contactless transfer of motion by way of the magnetic coupling across a static physical barrier, which can more easily be sealed (than a moving seal) to prevent leakage.

The containment shell must therefore function in conjunction with the magnetic coupling and has historically been a thin walled containment shell of a metallic, non-magnetic, construction, compatible with the liquid being pumped. However, one of the downsides with a metallic construction is that eddy currents are created and this leads to eddy current losses that increase with shell diameter, increasing rotational speed and increasing wall thickness (due to increasing internal pressure requirements).

The eddy current parasitic loss has limited the range of application opportunities for seal-less, magnet drive, centrifugal pumps. However, in recent years, alternative materials of construction such as carbon fibre composites and ceramics have been used for the containment shell. The primary technical and operational advantage of these material is that they reduce, or in the case of ceramics completely eliminate the eddy current loss. However, alongside the technical and operational advantage, there is a significant downside. The use of these materials results in high set-up costs, unit manufacturing costs and costs associated with the yield of the parts produced.

The pump needs to have process fluid recirculated through the back of the wet side of the pump, i.e. within the containment shell, so as to lubricate one or more of the moving parts within the pump. This is achieved by drawing off a portion of the pumped process fluid and directing into the space contained by the containment shell. It is beneficial to be able to determine one or more properties of the fluid within the containment shell to ensure proper ongoing operation of the pump. For example, it may be desirable simply to sense the presence or otherwise of the fluid to ensure that the pump is primed ahead of operation. It may also be desirable to sense a property of the process fluid such as temperature, pressure or flow rate to monitor operation of the pump.

This is difficult to achieve in conventional magnet drive pumps as no access is provided to locate sensors close to, or inside, the diverted process flow in the back side of the pump or within the containment shell.

According to the present invention there is provided a magnetic pump comprising: a pump body supporting an output shaft on a wet side of the pump and having an inlet and at least one outlet for pumped fluid; an input drive element on a dry side of the pump, at least one magnet for coupling the input and output shafts such that motion of the input shaft causes motion of the output shaft, a pressure containing structure mounted on the pump body for separating the dry and the wet sides, wherein the pump includes: one or more pathways through which pumped fluid can pass so as to lubricate one or more moving parts within the pressure containing structure, and a monitoring port/channel through which one or more properties of pumped fluid passing through the one or more pathways can be sensed.

Thus, the present invention provides a pump which include one or more monitoring ports or channels which permit access to be easily obtained to the process flow which is diverted into the back side of the pump to lubricate one or more moving parts.

The pump body preferably includes a bush holder around the output shaft. The monitoring port pathway preferably passes through the bush holder.

The monitoring port pathway may extend from a radially inward position to a radially outward position. The monitoring port pathway may extend to an outer edge of the bush holder. The monitoring port pathway is preferably elongate in a radial direction of the bush holder. The monitoring port pathway may bifurcate within the bush holder.

The monitoring port may be on an inlet side of the one or more pathways. The monitoring port may be on an outlet side of the one or more pathways. A second monitoring port may be provided on the other of the inlet or outlet sides.

The input drive element may include a drive shaft.

The magnetic coupling preferably includes at least one magnet on each of the input drive element and the output shaft.

A motor may be coupled to the input drive element.

The bush holder may include one or more pockets adjacent to the monitoring port or channel.

In one example, the shell is formed constructed from a composite material, which may include PEEK (Polyetheretherketone, a semi-crystalline organic polymer thermoplastic exhibiting a highly stable chemical structure) and randomly aligned carbon fibre strands. Preferably, the carbon fibre strands are between 35 and 45% by volume of the composite, more preferably 37.5 to 42.5% by volume and most preferably 40% by volume. Alternatively, the shell may be a more conventional metallic, non-magnetic construction, or may be formed from other composites or ceramic materials.

The containment shell may be manufactured by an injection moulding process, when it includes chopped, short strand carbon fibres as the material reinforcement. Injection moulding allows individual shells to be formed quickly and accurately, and with minimal human interaction, meaning that the cost per unit is significantly lower than that which can be achieved by standard processes.

The random alignment does result in a lower internal pressure capability for the part, when compared to an alternative composite material configuration for a similarly sized structure, but importantly it maintains the elimination of eddy current losses. The lower internal pressure capability is still acceptably high, for certain magnetic drive pump types. The injection moulding process is faster, allowing a higher rate of manufacture, eliminates quality and yield issues associated with for example a 'fibre lay-up' composite manufacturing process, results in better component repeatability and is generally a more cost-effective manufacturing solution.

PEEK is beneficial as it displays high resistance amidst a wide range of chemical environments, and at elevated temperatures. It can only be dissolved by certain materials including some acids, so permits many highly corrosive fluids to be pumped. It also provides good friction as well as wear properties, and can for example, be exposed for a long period of time to high pressure water and steam without exhibiting any serious degradation.

A shell formed using chopped carbon fibre strands is more robust when dealing with disrupted operation as well. The use of PEEK as the matrix material within which the carbon strands are distributed does not require cooling, in the way that certain metallic shells do—the lack of eddy currents in the invention ensure that the shell is not being heated in operation and increases the robustness of the pump to process upsets. Further advantages of fact that injection moulding can be used as a manufacturing method include (i) that the amount of post formation machining to achieve the desired product finish is reduced or indeed eliminated, and (ii) the side wall of the shell can be formed with parallel surfaces more easily, when compared to other composite material configurations or metallic shells formed over a mould from which the shell must be removed. For this to happen, the sides of the metallic or alternative composite configuration shells taper inwards slightly towards the closed end of the shell. Any form of adverse taper, i.e. where the open end is narrower than the closed end of the shell, would prevent the shell being removed from the mould, hence the standard practice of creating a slight taper towards the closed end.

In a pump of the present invention, it is preferable that the shell is the only pressure containing structure. By this, we mean that the composite material and randomly aligned carbon strand structure is able to withstand the operating pressures without support from other structures. Typical operating pressures can be up to 25 bar, so the shell is preferably able to withstand such pressures without other structures, such as bands or loops or additional layers of strengthening materials being applied.

The containment shell may include an integral vortex breaker feature on its inner surface. The vortex breaker may take the form of a cross or other cruciform shape and is preferably located in the centre of the inner surface of the closed end of the shell. The vortex breaker has two functions. Firstly, by being integrally formed with the shell, it strengthens the end closure part of the containment shell and, secondly, the projection of the vortex breaker away from the inner surface prevents liquid inside this end of the containment shell from swirling in a fixed location, thereby reducing wear or erosion damage to the inner surface of the shell. Given that the fluid to be pumped could be under extreme pressure and/or moving at significant velocities and/or maybe corrosive and/or toxic, the integrity of the shell is paramount to safe operation of the pump.

The present invention will now be described by way of example with reference to the accompanying drawings. In the drawings:

FIG. 1 is an axial section through one example of a magnetic seal less pump 10 incorporating a pressure containment shell 22.

Figure 1:
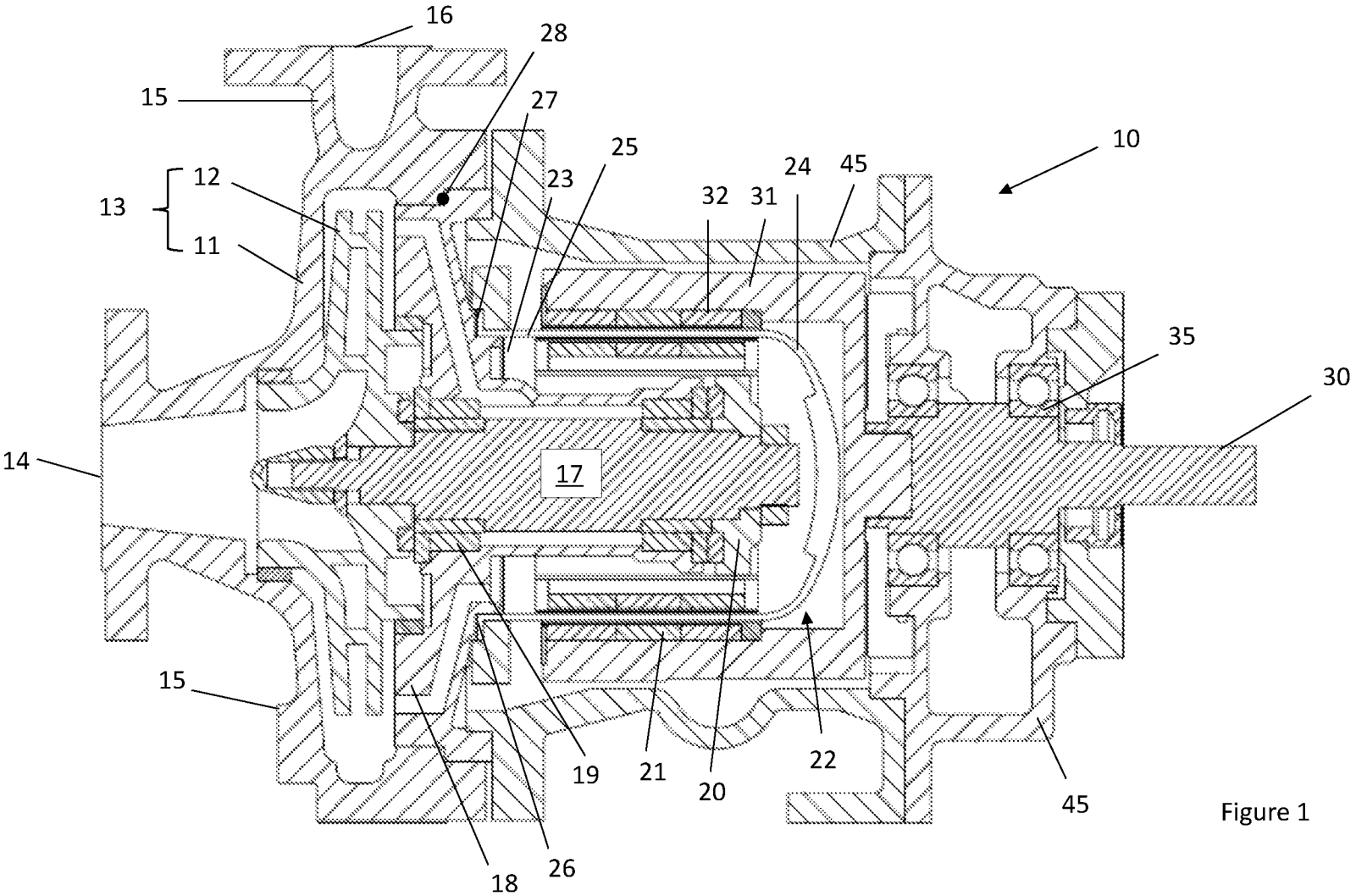
FIG. 1 shows a magnet driven pump.

The pump 10 includes a casing 11 and an impeller 12 that form what is typically described as the hydraulic 13. In common with all other types of centrifugal pump, the hydraulic 13 includes a suction nozzle 14 through which liquid is drawn into the hydraulic and then by virtue of the rotation of the impeller and the design of the casing volute 15, is expelled at a higher pressure, through the perpendicular, discharge nozzle 16 (at the top of the illustration). The casing volute 15 is a curved funnel that increases in area as it approaches the discharge port 16. The volute of a centrifugal pump is the part of the casing 11 that receives the fluid being pumped by the impeller 12, reducing the velocity of the fluid and converting kinetic energy into pressure head, as the fluid is directed through the discharge nozzle 16.

An output drive shaft 17 is connected to, or formed integrally with, the impeller 12 and extends axially along the pump 10, passing through bush holder 18 which is mounted on/connected to the casing 11. One or more axial and radial bearings 19 fix the radial axial and radial position of the output drive shaft with respect to the bush holder and permit rotation of the shaft relative to the bush holder.

The output drive shaft includes an inner rotor 20 which retains one or more inner magnets 21. A containment shell 22, having an open end 23, a closed end 24 and a side wall 25, passes over the output drive shaft 17, the bearings 19, the bush holder 18 and the inner rotor 20. In this case, the containment shell 22 has, at its open end, a flange 26 which is mounted and sealed to the bush holder 18. The sealing is achieved by way of one or more seals 27, typically one or more gaskets. The flange is relatively short (in the radial direction) when compared to the height of the containment shell. By height of the shell, we mean the distance from the open end to the closed end.

The containment shell 22, the bush holder 18, the output drive shaft 17, the impeller 12 and the casing 11 thereby define the wet output side of the pump. There are no moving seals, thereby reducing the risk of leakage of the pumped fluid.

The impeller 12 is caused to rotate due to application of an input rotation on a dry input side of the pump 10. The input rotation is provided in this case by an input drive shaft 30 which is coupled with an input drive element, in this case an outer rotor 31 which includes one or more outer magnets 32. The outer rotor 31 is positioned around the outside of the containment shell so that the outer magnet(s) 32 are aligned with the inner magnet(s) 21 such that rotation of one of the rotors causes the magnetic attraction between the inner and outer magnet(s) to create motion in the other rotor. The outer magnets 32 and the inner magnets 21 are typically aligned and spaced only a small distance from the containment shell.

In use, the input shaft 30 is rotated by some form of drive means such as a motor (not shown) which transfers rotation to the outer rotor 31. The magnetic attraction between the outer 32 and inner 21 magnets causes the output drive shaft 17 to be rotated, thereby rotating the impeller. This causes fluid to be drawn axially into the hydraulic 13 via the suction nozzle 14. Continuing rotation of the impeller draws fluid through the impeller and increase the pressure of the fluid to drive it out of the discharge port 16.

Thus, the magnetic coupling is comprised of the outer magnet ring (OMR) formed by the outer rotor 31 and the outer magnet(s) 32, an inner magnet ring (IMR) formed by the inner rotor 20 and the inner magnet(s) 21, and the containment shell 24. The OMR which is supported by a rolling element bearing assembly 35, spins in air outside of the shell 24 and is driven by a motor (via the drive shaft 30). The bearing assembly ensures that the outer rotor 31 runs concentric to the inner rotor and containment shell. The containment shell 22 is a thin shelled pressure boundary, containing the process liquid, through which the magnetic flux between the OMR to the IMR travels, enabling the synchronous rotation of the OMR and IMR (or magnetic coupling). The IMR is connected to the impeller 12 via the output shaft 17 to form the pump rotor.

The axial and radial bearing(s) 19 may include sleeves on the output shaft 17 and provide radial bearing support to the IMR and output shaft 17. These typically run against static bushes fitted to the bush holder 18 to radially support the pump rotor. Thrust bearing parts are fitted to the IMR and the impeller and react to pump rotor thrust loads. The bearing parts may be formed from any suitable bearing material.

The dry input side of the pump is covered by an outer coupling housing 45 which ensures that the outer rotor 31 is enclosed, locates the bearing housing 46 and limits outer rotor 31 excursion, in the event of bearing failure.

Magnetic drive pumps are characterised by their use of the magnetic coupling as described above and this necessitates process liquid lubrication of the pump rotor bearing system. This enables highly corrosive/toxic process liquids, or very high temperature/pressure process liquids, to be pumped but yet maintain a safe pressure boundary.

Figure 2:
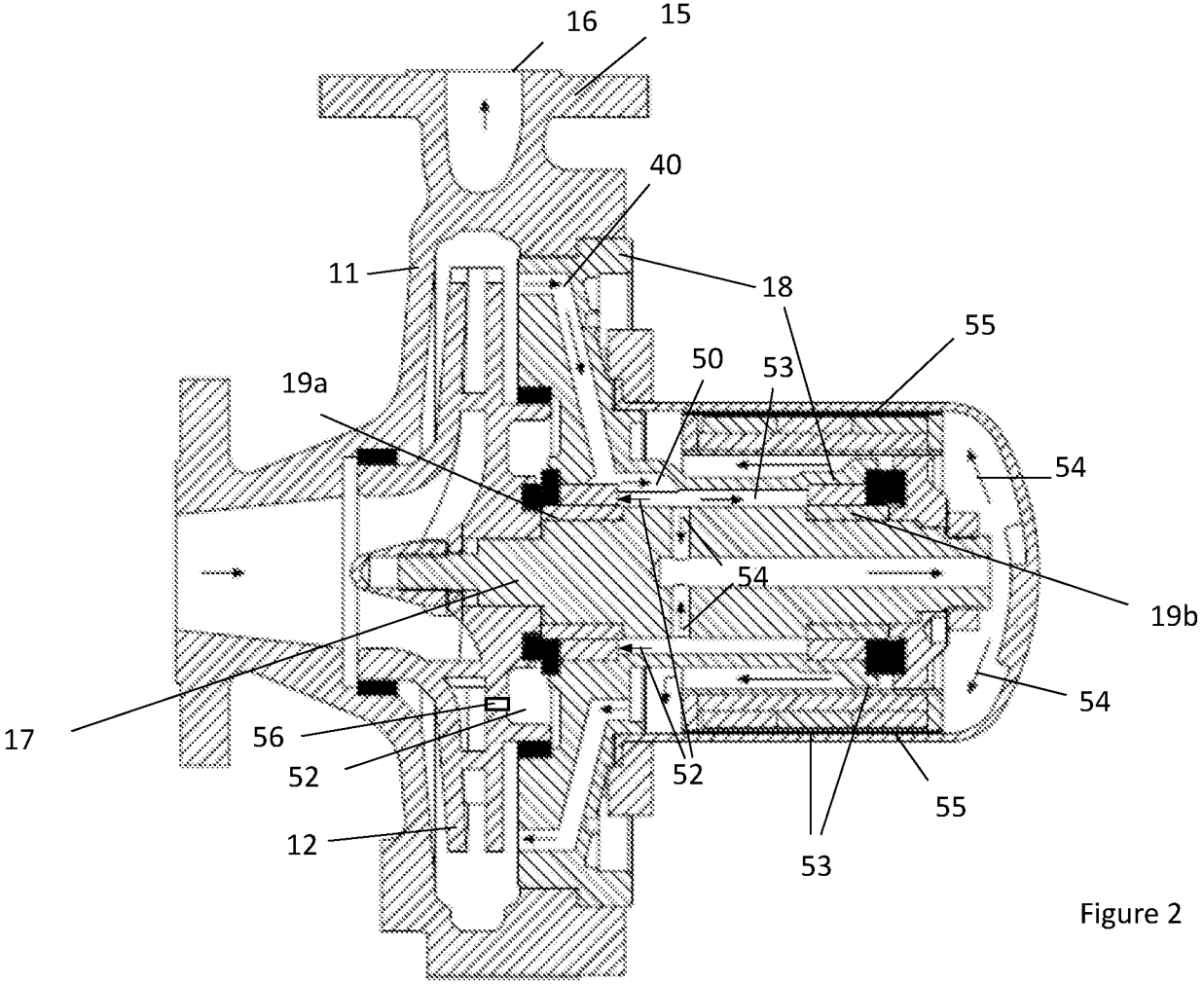
FIG. 2 shows the internal flow of process fluid through a magnet driven pump.

FIG. 2 illustrates the process liquid flow direction through the pump and how the process liquid itself is used to lubricate the bearings 19.

At the LHS of FIG. 2, the bulk flow of the process liquid into the pump 10 through the suction nozzle 14 is shown. This flows through the impeller 12 (by virtue of impeller rotation), is pressure recovered by the casing volute 15 and then exits through the discharge nozzle 16 at the top of the illustration.

There are two mechanisms of feeding the internal flow system. These are typically described as 'external feed' and 'internal feed'.

FIG. 2 illustrates an 'internal feed' system, symbolised by arrowed line 40 whereby a hole and flow path through the bush holder 18 takes process liquid at close to the impeller 12 discharge or outside diameter into the back of the pump. The back of the pump is the region enclosed by the containment shell 22 and the bush holder 18, and containing the bearings 19, the output drive shaft 17, the inner rotor 20 and inner magnet(s) 21.

Either way (whether external feed or internal feed), the flow into the back of the pump flows into a central region of the bush holder 18. At this central region 50, the flow splits in three directions.

The first direction is a flow path 52 through the front radial and axial bearings 19*a* (i.e. to the left in FIG. 2), lubricating these bearings and returning to the casing/impeller, bulk process liquid flow via one or more impeller balance holes 56.

The second direction 53 is a flow path through the back radial and axial bearings 19*b* lubricating these bearings and then returning to the casing 11 by the arrowed path shown at the bottom of the illustration via one or more impeller balance holes 56.

The third direction 54 is through cross-drillings in the output shaft 17, down the centre of the output shaft and out (at the right of FIG. 2) along a small annular gap 55 between the IMR and the containment shell. This flow would cool the containment shell if necessary and centralises rotation, and the flow then returns to the casing 11 by the arrowed path shown at the bottom of the illustration.

In this example, the containment shell 22 is formed from a composite material made up of a bulk matrix with chopped carbon fibre strands randomly arranged therein. One of benefits of such a construction over an alternative composite material configuration is now described with reference to FIG. 3.

Figure 3:
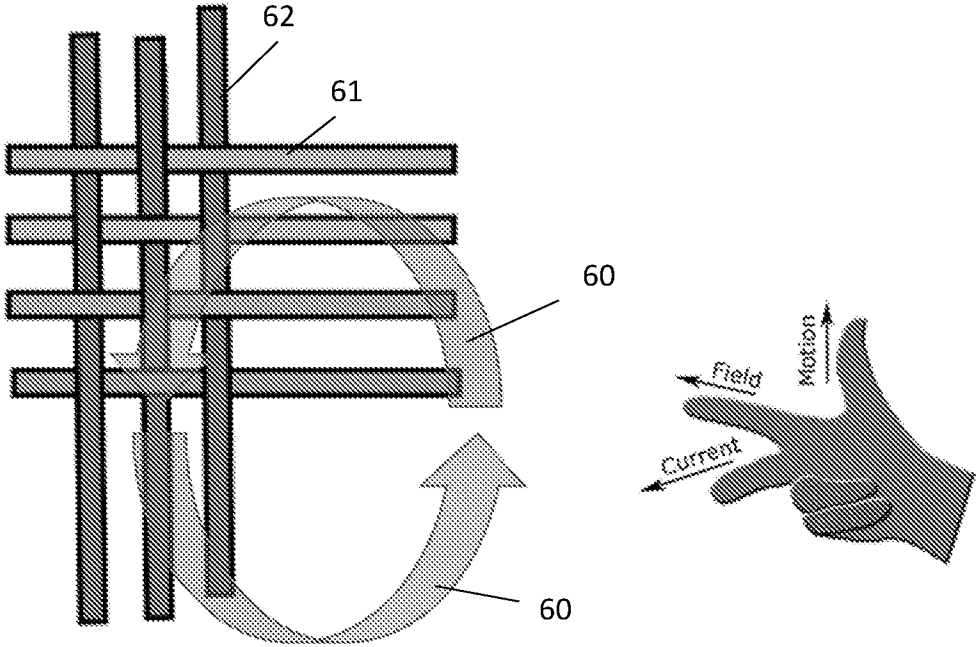
FIG. 3 shows a schematic representation of eddy current generation.

Consider an alternative composite material configuration, typically a carbon fibre/PEEK composite material as a plain weave, fibre lay-up, flat plate as shown 'magnified' in FIG. 3. If the magnetic flux passes perpendicularly through the composite material (i.e. in to the paper of the page) and the magnetic field moves upwards due to motion of the magnetic coupling parts, then an eddy current is generated, in accordance with Fleming's right hand rule.

If the magnetic flux alternates as it passes through the composite material, that is by passing magnets of alternate north-south-north-south polarity, then the magnetic field direction reverses and the composite material (which is static) will see a rotation of the eddy current, which will cross the warp 61 and weft 62 of the composite weave, as shown by the arrows 60.

Although carbon fibre is electrically conductive, because the eddy current is trying to rotate and pass through the warp and weft of carbon fibre weave, which is to an extent insulated by the composite matrix, the eddy current formation is reduced when compared with a metallic shell for example.

If this construction is used as the pressure vessel between the magnetic coupling parts of a magnetic drive pump, then the albeit reduced eddy current formation in the carbon fibre/PEEK composite material will still result in a magnetic coupling loss that can affect the operation of the pump.

If, instead of the regular lay-up shown in FIG. 3, the composite material is then changed to a short strand injection moulded carbon fibre/PEEK composite, then the carbon fibre strands are randomly aligned, in three dimensions, within the matrix material. The strands may be less than 1 mm in length.

Using this material as before and passing an alternating magnetic field (or flux) whilst the material is static, the formation of a rotating eddy current in a matrix of randomly aligned, short strand carbon fibres is reduced to zero or very close to it. In practice, a pressure containment shell for a magnetic drive pump, constructed using such a technique, would have a magnetic coupling loss of zero.

Figure 4:
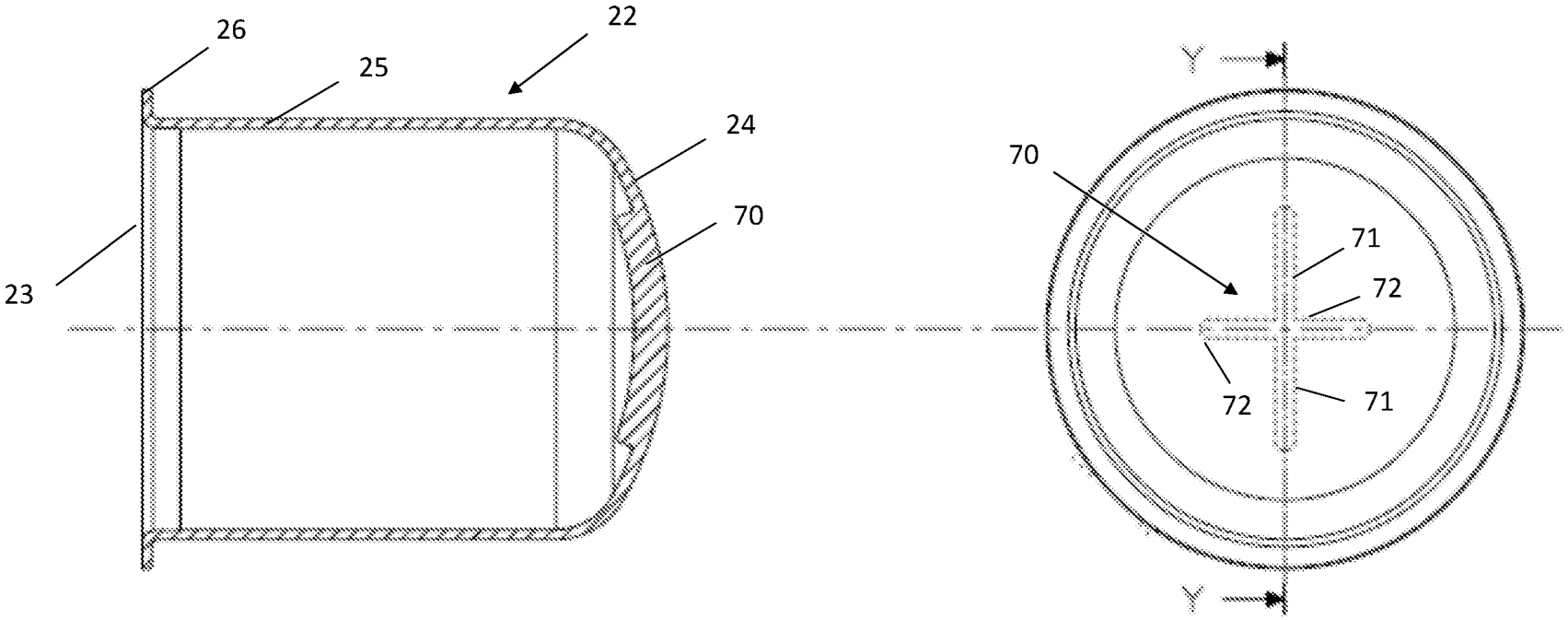
FIG. 4 shows a containment shell with a vortex breaker.

FIG. 4 shows one example of a containment shell 22 having a vortex breaker 70 integrally formed therewith. The vortex breaker has a cruciform shape, that is a cross with four arms 71, 72. The number of arms can be more or less than 4. In this example, arms 71 are shorter than arms 72, such that one dimension of the vortex breaker along the closed end wall of the containment shell 24 is longer than the other. The cruciform shape may project between 2 and 6 mm from the inner surface of the shell. Where the end wall of the shell is domed, the vortex breaker may extend over an arc of between 30 and 45 degrees of the radius of curvature of the dome.

By virtue of the structure of the containment shell, that is a composite material which is preferably injection mouldable and formed of a matrix material and short randomly aligned carbon fibre strands, the vortex breaker can be integrally formed with the shell. This provides numerous benefits including increased strength to both the vortex breaker itself and also to the shell, as the projections of the vortex breaker away from the surface of the shell braces the end wall.

In operation of the pump, process fluid is caused to flow in the gap between the containment shell 24 and the output shaft 17 and IMR 20, and in particular can be ejected axially from the centre of the output shaft. The vortex breaker aims to disrupt this flow and prevent the formation of a vortex (or swirling liquid) adjacent the containment shell end. This ensures that the internal flow is maintained, but eliminates the liquid swirl that has potential to cause wear degradation, especially if any unwanted debris was entrained in the flow.

Figure 5:
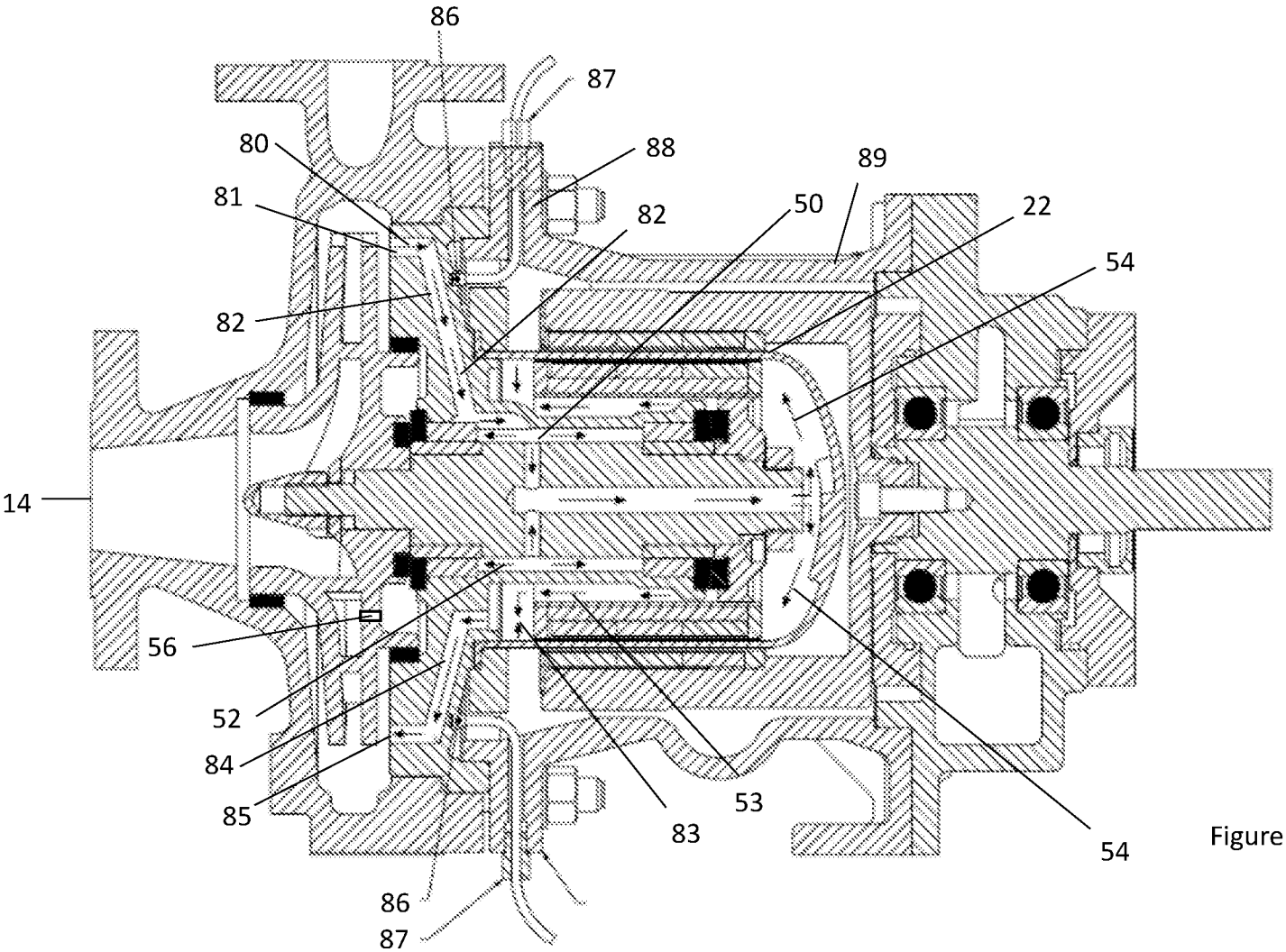
FIG. 5 shows the internal flow of process fluid using the bush holder of FIG. 6.

The pump assembly shown in FIG. 5 has much the same configuration as the pump 10 of FIGS. 1 and 2, so like features have been labelled with the same reference numerals.

The internal feed starts at port 81 which receives a portion of the pumped process fluid from impeller 12. The separated process flow is fed along inlet passageway 82 to the central region 50 of the bush holder 18. The flow is then directed as described in FIG. 2 around the three separate flow directions. Flows 53 and 54 recombine at point 83 where the process flow then passes along outlet passageway 84 and out of the bush holder 18 and outlet port 85.

On either or both of the inlet and outlet passageways, one or more sensors 86 may be provided. The sensors may be used to measure various properties of the process fluid including, but not limited to: flow rate, temperature or pressure. This can help to ensure correct operation of the pump, for example ensuring that the pump is primed with process fluid or some other fluid ahead of initiating operation, thereby minimising wear and ensuring a smooth start to the pumping process.

Access for measurement to either the inlet or the outlet passageway can be either intrusive or non-intrusive. "Intrusive" would be a hole through the wall of the bush holder 18 to fit a sensor directly into the process liquid stream within the passageway. With hazardous liquids, an intrusive sensor has to be sealed into position and there is therefore an ongoing risk of leakage. A "non-intrusive" sensor relies on typically an ultrasonic signal that transmits through the wall of the inlet/outlet port, senses the liquid properties, but doesn't have the risk of liquid leakage.

The sensors could be wireless in that they transmit any signals using a wireless data protocol, or they may be wired, as in FIG. 5, thereby necessitating a further pathway 87 to wire-out the sensor(s). This is typically managed by a radial feed-through arrangement in a flange 88 of a coupling housing 89.

The radial position of the inlet/outlet sensor(s) may be dependent on the property being measured. An outlet flow sensor would for example need to be further inboard (i.e. radially more inward) than currently shown in FIG. 5, although the more outboard location shown may be suitable for a pressure or temperature sensor.

Figure 6:
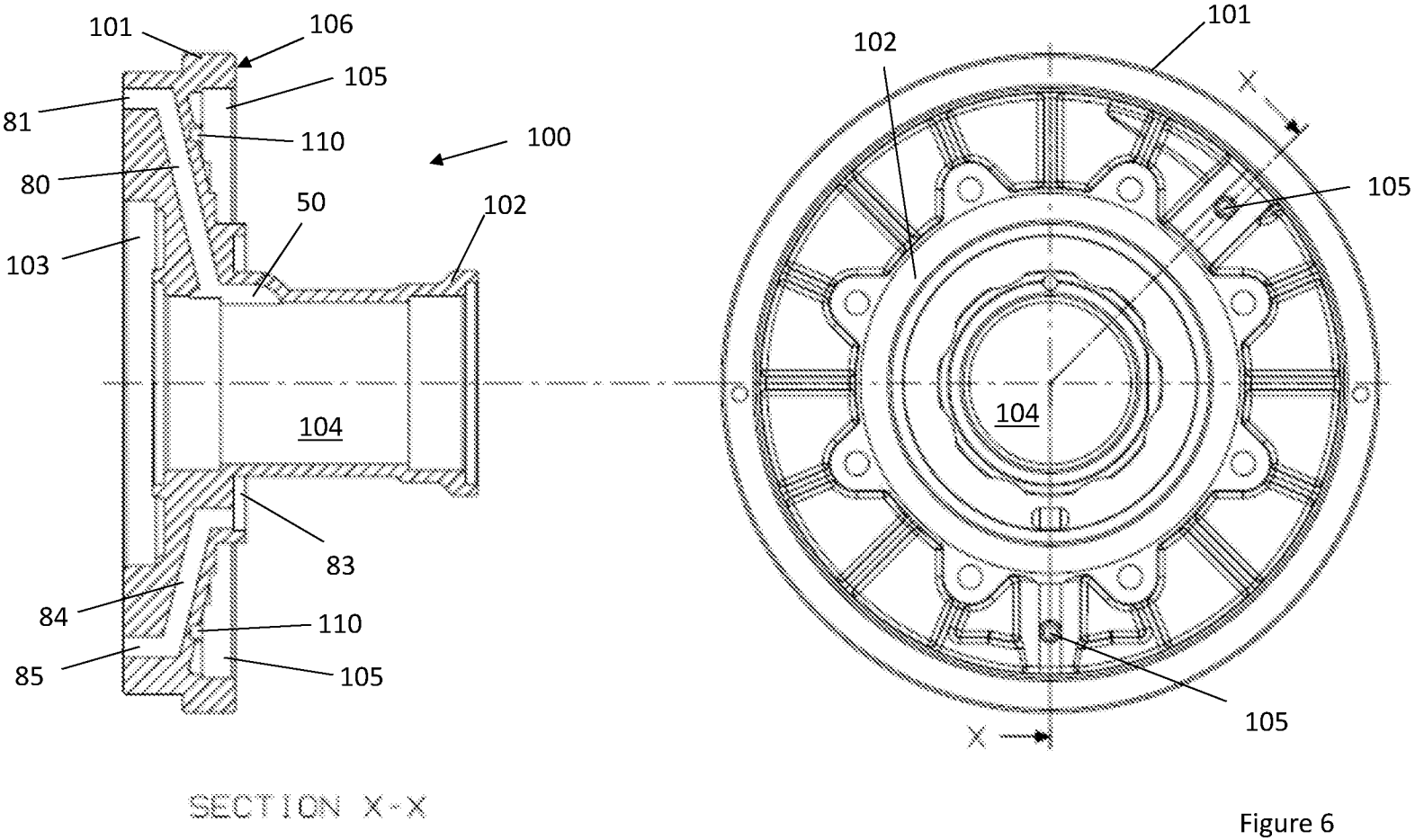
FIG. 6 shows the bush holder from FIG. 5 in more detail.

A suitable bush holder 18 for use in FIG. 5 is shown in greater detail in FIG. 6. The bush holder performs a multitude of functions in the pump:

- Retains system pressure at the back of the hydraulic part of the system within the containment shell 24
- Locates the seal(s) 27 and 28 between the bush holder 18 and containment shell 22 and the bush holder 18 and casing 11, respectively
- Locates to the casing 11, pump casing, bearings 19 and containment shell 22
- Allows process liquid into and out of the back of the pump to cool and lubricate bearings 19

The bush holder 18 has a main body 100 formed from a disc shaped section 101 and a hollow tube section 102 projecting away from the disc section 101 at its centre. The disc has a central hole aligned with the hollow tube 102 to define a passageway 104 from one side of the bush holder to the other. This passageway, in use, accommodates the output drive shaft and the associated bearings.

The disc section 101 includes an inlet passageway 80 extending between an inlet port 81 and the central section 50 of the bush holder. The disc section further includes an outlet passageway 84 extending from the recombination point 83 to an outlet port 85. As described with reference to FIG. 5, the bush holder helps to distribute a portion of the process flow which is delivered into inlet port 81 around the bearings 19 and inner rotor, the output drive shaft and into the space defined by the containment shell 24.

The inlet and outlet passageways may be opposite each other across the disc section, or may be off set as shown in FIG. 6. The outlet passage way is shown at approx. 135 degrees from the inlet passageway.

The disc section 101 of the bush holder includes various pockets 105 on the inner face 106. These pockets allow ready access to the inlet 80 and outlet 84 passageways and/or the inlet 81 and outlet 85 ports. For the non-intrusive sensing, the pockets enable the sensors to be placed close to the monitoring points, thereby minimising the amount of material that the signals need to penetrate. For intrusive sensing, the pockets enable the sensors to be located with the outline of the bush holder meaning that no other components need to be adapted.

As shown in FIG. 5, pathway 87 for the sensor extends radially through the coupling housing 89 before turning through substantially 90 degrees and passing axially through one of the pockets 105, i.e. through the axial end face 106 on the bush holder disc 100. The pocket 105 may be provided with a recess 110 into which the sensor 86 can be located to assist with placing the sensor sufficiently close to, but not within, the process liquid stream, thereby aiding accurate non-intrusive sensing. If a wireless sensor is used, this may be located directly in the pocket 105 and within the recess 110 if provided (without the need for passage 87).

The monitoring port or channel therefore may include any of the recess 110, the pocket 105 within the bush holder and/or the passage 87 through to a position external to the pump. The monitoring port or channel therefore provides a location for a sensor to be placed and ability for a signal from that sensor to be obtained, either wirelessly or by way of a wired connections passing out of the pump.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A magnetic pump comprising:

a pump body supporting an output shaft on a wet side of the pump and having an inlet and at least one outlet for pumped fluid;

an input drive element on a dry side of the pump, at least one magnet for coupling the input drive element and output shaft such that motion of the input drive element causes motion of the output shaft, a pressure containing structure mounted on the pump body for separating the dry and the wet sides, wherein the pump body includes a bush holder around the output shaft, wherein the bush holder is mounted on or connected to a pump casing, and, wherein the pump further includes:

one or more pathways through which pumped fluid can pass so as to lubricate one or more moving parts within the pressure containing structure, and a monitoring port through which one or more properties of pumped fluid passing through the one or more pathways can be non-intrusively sensed, wherein the monitoring port passes into the bush holder, wherein a pathway of the monitoring port bifurcates within the bush holder.

2. The magnetic pump according to claim 1, wherein a pathway of the monitoring port extends from a radially inward position to a radially outward position.

3. The magnetic pump according to claim 1, wherein a pathway of the monitoring port extends to an outer edge of the bush holder.

4. The magnetic pump according to claim 1, wherein a pathway of the monitoring port is elongate in a radial direction of the bush holder.

5. The magnetic pump according to claim 1, wherein at least part of the monitoring port is in an axial end face of the bush holder.

6. The magnetic pump according to claim 1, wherein the monitoring port extends from adjacent to a pathway though which pumped fluid can pass to a location external to the pump.

7. The magnetic pump according to claim 1, wherein the monitoring port includes a right angle turn.

8. The magnetic pump according to claim 1, wherein the monitoring port is on an inlet side of the one or more pathways.

9. The magnetic pump according to claim 1, wherein the monitoring port is on an outlet side of the one or more pathways.

10. The magnetic pump according to claim 8, further comprising a second monitoring port on an outlet side of the one or more pathways.

11. The magnetic pump according to claim 1, wherein the input drive element includes a drive shaft.

12. The magnetic pump according to claim 1, wherein the at least one magnet includes at least one magnet on each of the input drive element and the output shaft.

13. The magnetic pump according to claim 1, further comprising a motor coupled to the input drive element.

14. The magnetic pump according to claim 1, wherein the bush holder includes one or more pockets adjacent the monitoring port.

15. The magnetic pump according to claim 9, further comprising a second monitoring port on an inlet side of the one or more pathways.

* * * * *